United States Patent [19]

Bush

[11] Patent Number: 4,944,043

[45] Date of Patent: Jul. 31, 1990

[54] TEAM DESIGNATOR BELTS

[76] Inventor: Janet Bush, 15 Orchard Rd., Castleton, N.Y. 12033

[21] Appl. No.: 173,885

[22] Filed: Mar. 28, 1988

[51] Int. Cl.[5] ..... A41F 19/00; A41F 15/00

[52] U.S. Cl. ..... 2/308; 2/310; 2/312; 2/338; 2/DIG. 6; 224/208

[58] Field of Search ..... 2/300, 308, 310, 311, 2/312, 305, 322, 327, 328, 338, 340, DIG. 6; 224/208, 215, 901

[56] References Cited

U.S. PATENT DOCUMENTS

| | | | |
|---|---|---|---|
| 600,331 | 3/1898 | Lanz | 2/322 |
| 740,265 | 9/1903 | Freeman | 2/328 X |
| 3,086,529 | 4/1963 | Munz et al. | 2/311 X |
| 3,089,143 | 5/1963 | Jacobson | 2/310 X |
| 3,848,270 | 11/1974 | Rand | 2/311 |
| 4,096,977 | 6/1978 | Barville et al. | 224/901 X |
| 4,472,839 | 9/1984 | Johansen | 2/338 |
| 4,483,336 | 11/1984 | Deitch | 2/310 X |
| 4,501,028 | 2/1985 | Gottschall | 2/338 |
| 4,534,619 | 8/1985 | Bedford | 2/338 X |

FOREIGN PATENT DOCUMENTS

| | | | |
|---|---|---|---|
| 2050810 | 1/1981 | United Kingdom | 2/311 |

*Primary Examiner*—Wm. Carter Reynolds

[57] ABSTRACT

Athletic team identification belts are made of vinyl and are secured by VELCRO type fasteners. An additional fastener secured toward the center of the belt, on the inside surface, allows a second belt to be secured to the first, and draped over the users shoulder. The material portion of the fasteners extend at intervals along the belt from one end at least one third of the length of said belt, on the outside surface. The hook fasteners are on the inside toward the other end of the belt in a strip preferably one half inch wide. In an alternate embodiment the hooks are located on the outside surface of the belt.

8 Claims, 2 Drawing Sheets

TEAM DESIGNATOR BELTS

FIELD OF THE INVENTION

Generally this invention relates to belts. More specifically, this invention discloses a belt which may be used for identifying players on a team.

BACKGROUND OF THE INVENTION

Virtually all elementary and secondary schools have mandatory physical fitness programs. In these programs a variety of physical fitness activities are practiced. Many of these activities involve teams and the separation and designation of class members into opposing teams. This type of team activity is an excellent Way to involve a large number of people simultaneously while fostering enthusiasm through competition and team spirit.

However, a problem often develops When the team sport involves the intermingling of team members during the playing of the game. In such a situation the players must be able to differentiate between the members of their team and those of the opposing team. For males, it is common to differentiate by having one team wear shirts and the other team remove their shirts (skins). While this method of shirts vs. skins is effective it has several drawbacks. Clearly, this approach only works when the weather permits or if the play is indoors. Furthermore, those students without shirts have a greater risk of injury, especially scratches and abrasions. Also, when the teams are playing indoors it is common for the gym floor to become wet, especially when a player not wearing any sort of absorptive material falls or for any other reason comes in contact with the floor. This of course creates wet spots which are potentially very dangerous to all players. Aside from the physical difficulties there is also a psychological factor which enters the picture when a player has a self image problem due to being overweight or very thin. These players virtually dread the possibility of being on the team without shirts and especially where male and female classes share the same gymnasium this exposure can be most embarrassing.

Commonly, female teams are given colored tops, similar to tank tops, which are worn over their gym outfits. Each team member wears the same color top and thus the players can quickly differentiate between opposing team members.

The cost of these designator tops is born by the school since it would he impractical for students to buY their own given the fact that they would need different colored tops depending on which teams they were on. For this reason the schools generally buy two sets of tops each set of course being a different color. The tops are worn during class and afterwards generally thrown into a basket or the like for use by the next class. Needless to say, after several classes the tops are totally repugnant to their users. This is not only unpleasant to the students but may also be unhealthy as germs are easily spread from student to student. Exacerbating the problem is the fact that schools generally do not have any type of laundry service. Therefore, the tops are handled like other school equipment, namely, thrown back into the bag or basket for use the next day. The washing of these tops, if it occurs at all, falls upon the gym teacher and it is obvious that even the most conscientious teachers cannot be expected to take home 50 or more tops each and every night for washing and drying. These tops thus go day after day, and even week after week without being cleaned.

In fact, it is not uncommon that these tops become so repugnant that the students treat them with disgust. Tops are commonly stretched, torn or otherwise abused to such a degree that numerous replacements must be ordered throughout the year.

SUMMARY OF THE INVENTION

It was in response to the above described problems that the subject invention was developed.

A vinyl belt of preselected colors fastened together with coacting fasteners such as those marketed and known by the name of Velcro. Such fasteners have a material portion, which for the purposes of this application will be referred to as the latch portion of the fastener, and a hook portion. The latch and hook portions are on opposite ends of the belt. In my preferred embodiment the hook portion is less than 1 inch in length and is preferably ½ inch in order to allow for disengagement of the belt when a sufficient amount of pressure is supplied. Located substantially centrally on the inside surface of the belt is another coacting fastener to which one end of a second belt may be secured. When secured the second belt may be draped over the players shoulder and secured to the appropriate coacting fastener on the front of the first belt. These belts may also be reversible with a different color on each side. The latch portions are located along the outside of the belt and starting toward one end cover about one third of the length of the entire belt. The hook portion is on the opposite side of the belt and at the other end of the belt so that the hook portion may be attached to any one of the latch portions when placed around the player. In an alternate embodiment the coacting fasteners are on the same side of the belt. Thus, the hook at the end of the belt where the hook is secured must be folded over in order to secure the hook to one of the latch members. Therefore, when there is sufficient pull on the belt a peeling motion will be created which will separate the hook from the latch portion and remove the belt. It is necessary to have easy removal of the belt for team play so that during the play of the game and individual grabbing another team players belt on purpose or accidentally will not injure the player since the belt will release.

DETAILED DESCRIPTION OF THE PREFERRED EMBODIMENT

Figure 1:
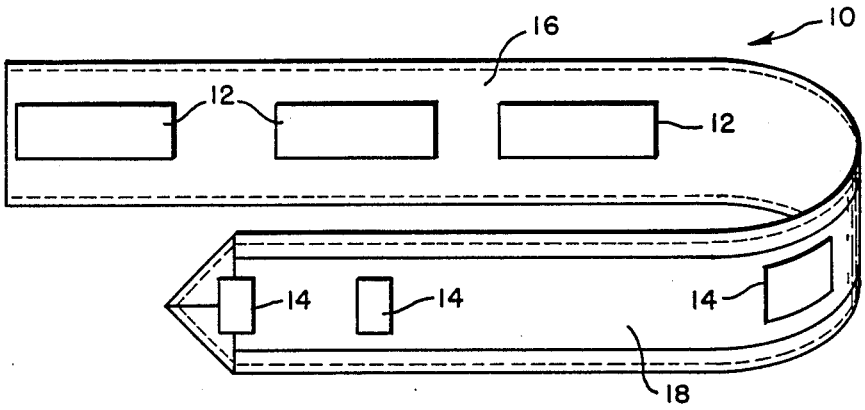
FIG. 1 is an elevational view of the belt.

FIG. 1 discloses the belt generally designated as 10. The belt 10 is secured together by fasteners commonly known as Velcro fasteners Which have a material or a latch portion 12 on one side and toWard one end of the belt and hook portions 14 on the opposite side and toWard the opposite end of the belt. The latch portions 12 are on the outside surface of the belt and are spaced at intervals covering at least one third of the belt length. The hook portions 14 are less than 1 inch in length and are preferably only 1/2 inch so that when the belt is secured around the individual a pull upon the belt which would be of sufficient strength to unbalance the individual would instead disengage the belt. The latch portions 12 are on the outside surface 16 of the belt and the hook portions 14 are on the inside surface 18 of the belt. Positioned substantially in the middle of the belt on the inside surface 18 is a secondary hook portion 20.

Figure 2:
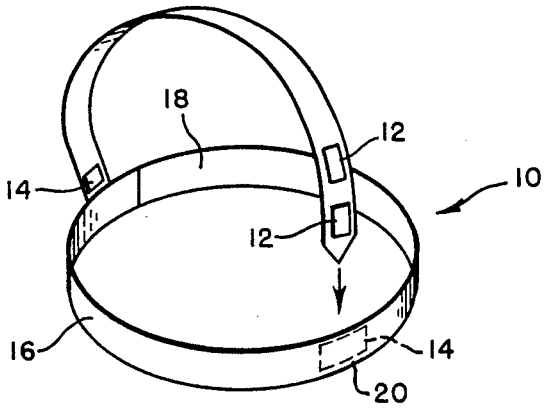
FIG. 2 is a perspective view of the two belt combination.

As shown in FIG. 2 two belts may be combined in order to provide for a belt around the waist and also a belt over the shoulder. In such a configuration the user simply places a first belt around his or her waist and then takes a second belt attaching the latch portions 12 to the secondary hook portion 20 and draping the belt over the shoulder, attaching the hook portions 14 to the latch portions 12 on the belt disposed around the users waist.

In my preferred embodiment the belt is made completely of vinyl, having the characteristics of being nonelastic and nonabsorptive, so that it may be easily wiped down and kept from soiling, in addition, the belts would be made of a predetermined color so that all the players on a given team could wear the same color belt and players on another team could wear a different colored belt.

Figure 3:
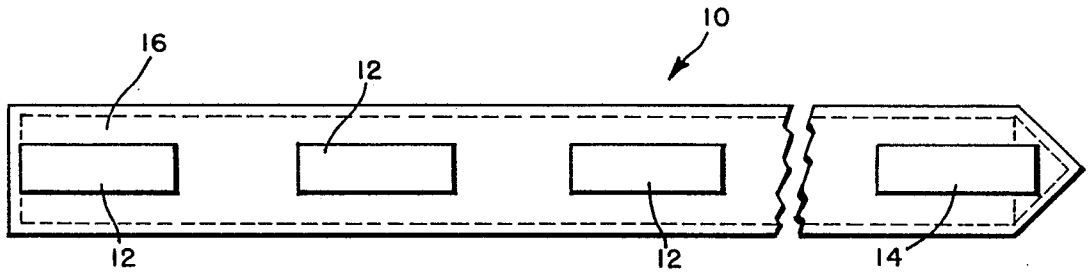
FIG. 3 is an elevational view of the alternate embodiment of the belt.
Figure 4:
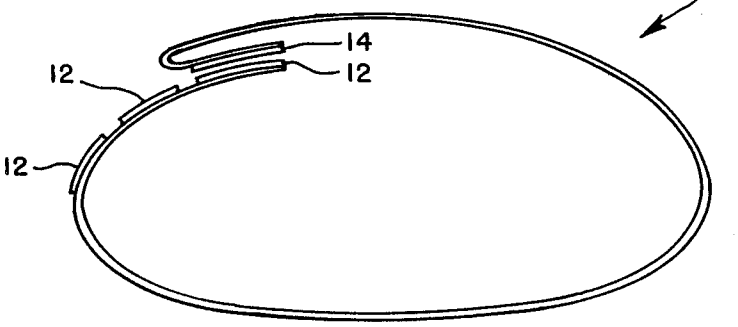
FIG. 4 is a top plan view of the alternate embodiment shown in FIG. 3 when being worn.

FIG. 3 shows and alternate embodiment wherein the hook portions 14 and the latch portions 12 are on the same side of the belt. This allows for a configuration as shown in FIG. 4 wherein the hook portion is turned inward in order to accomplish securing toward the latch portions 12. This is effective because of the nature of the Velcro fasteners which do not easily detach when simply pulled apart but are instead designed to disconnect upon a peeling as opposed to a shearing motion. Any extreme pressure applied to the belt will cause a peeling action separating the hook portions 14 from the latch portions 12 and releasing the belt without applying great pressure on the wearer.

The above describes the preferred embodiment of the invention however it is intended that the scope of the invention should only be limited by the claims which are appended hereto.

I claim:

1. An athletic team identification belt comprising:

an elongate strip of nonelastic colored material having inner and outer surfaces; and coacting fasteners on only one surface of the strip, the opposite surface of the strip being smooth and nonabsorptive, said fasteners of the type which are readily disengagable when a peeling force is applied, said fasteners secured toward opposite ends of said belt, whereby one of said ends is folded over in order to attach said fasteners.

2. The invention of claim 1 wherein the inside surface of the belt is of a different color then the outside surface of the belt, and the coacting fasteners comprise Velcro type fasteners.

3. The invention of claim 2 wherein the belt material is substantially nonabsorptive.

4. An athletic team indentification belt system comprising:

two belts, each belt having coacting fasteners, one of said fasteners located toward one end of said belt the other fastener located toward the other end of said belt, one of said coating fasteners extending further along the belt than the other fastener, said coacting fastener secured on opposite sides of said belt; and a strip of the same type as one of said coacting fasteners on the inside of each said belt secured on the inside surface substantially equidistant between the ends of said belt whereby one belt may be worn around the waist and the other belt may be worn over the shoulder, said waist belt secured by the coacting fasteners toward either end of the belt and said shoulder belt being secured at one end to the fastener substantially equidistant between the belt ends and the other end of said shoulder belt being secured to one of the coacting fasteners located toward the other end of the waist belts.

5. The invention of claim 4 wherein said belts are a predetermined color and the inside surface of each belt is of a different color than the outside surface of the said belt.

6. The invention of claim 4 wherein one of the coacting fasteners are hooks, said hook portions having a length of less than 1 inch on each belt.

7. The invention of claim 6 wherein said belts are made from a nonabsorptive type material.

8. The invention of claim 7 wherein said material is vinyl and the coacting fasteners are Velcro.

* * * * *